US009283576B2

(12) United States Patent
Steur, Sr.

(10) Patent No.: US 9,283,576 B2
(45) Date of Patent: Mar. 15, 2016

(54) DEVICE AND METHOD FOR IMPULSE EJECTION OF MEDIUM

(75) Inventor: Frans Steur, Sr., Sittensen (DE)

(73) Assignees: Martijn Steur, Sittensen (DE); Anne Karin Steur, Sittensen (DE)

( * ) Notice: Subject to any disclaimer, the term of this patent is extended or adjusted under 35 U.S.C. 154(b) by 1313 days.

(21) Appl. No.: 12/995,984

(22) PCT Filed: Jun. 2, 2009

(86) PCT No.: PCT/EP2009/056743

§ 371 (c)(1),
(2), (4) Date: Jun. 16, 2011

(87) PCT Pub. No.: WO2009/147139

PCT Pub. Date: Dec. 10, 2009

(65) Prior Publication Data

US 2011/0240759 A1 Oct. 6, 2011

(30) Foreign Application Priority Data

Jun. 3, 2008 (DE) ..... 10 2008 026 449

(51) Int. Cl.
*F02M 45/10* (2006.01)
*B05B 1/32* (2006.01)
*A62C 31/02* (2006.01)

(52) U.S. Cl.
CPC ..... *B05B 1/323* (2013.01); *A62C 31/02* (2013.01)

(58) Field of Classification Search
USPC ..... 239/452, 453, 456, 533.13, 533.14, 99, 239/438; 251/45, 212, 331, 335.1
See application file for complete search history.

(56) References Cited

U.S. PATENT DOCUMENTS 3,520,477 A * 7/1970 Cooley ..... 239/101
3,533,553 A * 10/1970 Britzman ..... 239/17

(Continued)

FOREIGN PATENT DOCUMENTS

DE 2817102 10/1979
DE 3139948 A1 * 4/1983

(Continued)

OTHER PUBLICATIONS

Anonymous, "Der Firehunter—Das Allzweck-Löschfahrzeug" IFEX GmbH, Jan. 26, 2005, Internet URL: http://web.archive.org/web/20020613202205/ifex3000.de/dfireh.htm, downloaded on Jan. 29, 2010, 2 pages.

*Primary Examiner* — Arthur O Hall
*Assistant Examiner* — Viet Le
(74) *Attorney, Agent, or Firm* — Seed IP Law Group PLLC

(57) ABSTRACT

A device for impulse ejection of a medium is provided having an ejection tube for the medium to be ejected therefrom through an ejection end of the ejection tube by way of a propellant in pulsed fashion in an ejection direction. The device further includes a membrane in the area of the ejection end, the membrane being elastically deformable during ejection of medium for forming a penetration opening for the medium, and a nozzle element in the ejection tube. The nozzle element is adapted to be movable along the ejection direction between a rest position and an ejection position, wherein the nozzle element effects a deformation of the membrane in the ejection position to form the penetration opening. A method of impulse ejection and a membrane for a device for impulse ejection of medium, and a method for increasing the range of an impulse ejection of medium are also provided.

18 Claims, 2 Drawing Sheets

(56) References Cited

U.S. PATENT DOCUMENTS

| | | | | | |
|---|---|---|---|---|---|
| 3,722,819 | A * | 3/1973 | Hall et al. | 239/99 |
| 3,784,103 | A * | 1/1974 | Cooley | 239/101 |
| 4,058,256 | A * | 11/1977 | Hobson et al. | 239/101 |
| 4,387,879 | A | 6/1983 | Tauschinski | 251/149.1 |
| 5,005,767 | A * | 4/1991 | Heren | 239/288 |
| 5,398,873 | A * | 3/1995 | Johnson et al. | 239/99 |
| 5,445,226 | A * | 8/1995 | Scott et al. | 169/15 |
| 5,979,791 | A * | 11/1999 | Kuykendal et al. | 239/99 |
| 6,119,955 | A * | 9/2000 | Starr | 239/11 |
| 6,464,150 | B1 * | 10/2002 | Zimmer et al. | 239/284.1 |
| 6,726,063 | B2 * | 4/2004 | Stull et al. | 222/212 |
| 6,769,492 | B2 | 8/2004 | Bauer et al. | 169/30 |
| 6,810,966 | B1 | 11/2004 | Bauer et al. | 169/58 |
| 6,868,915 | B2 | 3/2005 | Sans et al. | 169/26 |
| 2003/0189067 | A1 | 10/2003 | Stull et al. | |
| 2005/0171488 | A1 * | 8/2005 | Weaver et al. | 604/247 |
| 2005/0171510 | A1 * | 8/2005 | DiCarlo et al. | 604/537 |

FOREIGN PATENT DOCUMENTS

| | | |
|---|---|---|
| EP | 0689857 | 1/1996 |
| WO | 90/07373 | 7/1990 |
| WO | 0055019 | 9/2000 |
| WO | 0107117 | 2/2001 |
| WO | 0174452 | 10/2001 |
| WO | 0183032 | 11/2001 |

* cited by examiner

DEVICE AND METHOD FOR IMPULSE EJECTION OF MEDIUM

BACKGROUND

1. Technical Field

The present disclosure concerns a device for impulse ejection of a medium with an ejection tube for the medium from which the medium can be driven out by means of a propellant through an injection end of the ejection tube impulse-like in an ejection direction. The present disclosure also concerns a method for impulse ejection of a medium from an ejection tube of such a device for impulse ejection of the medium.

2. Description of the Related Art

Devices and methods for impulse ejection of a medium are described, for example, in WO 90/07373 A1 or EP 0 689 857 A2. In particular, fires can be extinguished with these devices and methods with relatively small amounts of extinguishing medium, the extinguishing medium being finely atomized or dispersed by impulse ejection and mixed with air. The high extinguishing effect can be achieved especially as a result of fine atomization or dispersal of the medium, for example, in the case of water as the extinguishing medium by formation of very fine water drops in the micrometer range.

In known devices and methods, fine dispersal or atomization essentially occurs directly after the medium emerges from the ejection tube. For example, in a commercial product of IFEX Technologies (IFEX Dual Intruder), at 25 bar of propellant pressure (air) with 3 to 12 L of water, a jet width of about 4.5 m is obtained at a distance of 20 m from the ejection tube. The extinguishing distance with the best efficiency here is 10 to 40 m. A portable device of IFEX Technologies reaches a maximum shooting length of 16 m with 0.25 to 1 L of water as a medium, and also with 25 bar of propellant pressure (air).

It can be an advantage to achieve a greater range during impulse ejection without requiring, for example, different dimensioning of the device, depending on the conditions under which a device and method for impulse ejection are to be used and depending on the targeted results with use.

BRIEF SUMMARY

One task of embodiments of the present invention is therefore to provide a device and method for impulse ejection in which greater range can be achieved with essentially equal dimensioning.

This task is solved according to embodiments of the present invention by a device for impulse ejection of a medium with an ejection tube for the medium from which the medium can be driven out by means of a propellant through an ejection end of the ejection tube impulse-like in an ejection direction, a membrane in the area of the ejection end, which can be elastically deformed during ejection of medium to form a passage opening for the medium, and a nozzle element in the ejection tube, which is designed to be able to move along the ejection direction between a rest position and an ejection position. The nozzle element in the ejection position thereby causes deformation of the membrane to form the passage opening and in the rest position causes less or no deformation of the membrane. Moreover, the nozzle element can be brought from the rest position to the ejection position during ejection of medium.

The task is also solved according to embodiments of the present invention by a method of impulse ejection of a medium from ejection of a device for impulse ejection of the medium in which the device has a membrane in the area of an ejection end of the ejection tube and a nozzle element in the ejection tube, the nozzle element during ejection of medium being brought from a rest position to an ejection position. Here the nozzle element causes deformation of the membrane in the ejection position to form a passage opening for the medium.

Embodiments of the present invention are based on the insight that one of the factors that limit range (and therefore also extinguishing distance) is the dispersal or atomization essentially occurring right after ejection. On the other hand, precisely this dispersal or atomization is critical for success in extinguishing fires with the use of such devices and methods. It was found that with a device and method according to embodiments of the invention, fine dispersal or atomization can be achieved which only occurs at a comparatively greater distance from the ejection tube, thus increasing the range of ejection of medium. The nozzle element is moved during ejection of medium from a rest position to an ejection position, in which case the nozzle element opens up the elastic membrane to a certain extent to form an outlet opening.

Owing to the fact that atomization or dispersal of the medium only occurs according to embodiments of the invention at a distance from the ejection tube, an advantageous effect is obtained for additional application possibilities for the device and method according to the invention. The medium can now be provided with an irritant and used without annoyance or even hazard occurring in the area of the ejecting device. For example, if water mixed with CS gas were to be "shot" from an ordinary device, because of directly occurring atomization of the CS-gas-water mixture, CS gas would also emerge in the area of the ejecting device, which does not make such use impossible with ordinary devices but does make it impracticable. Embodiments of the present invention can therefore be used especially advantageously in the area of riot control, i.e. controlling unrest in a crisis situation, and can therefore increase ordinary use of CS gas or similar gases on the one hand and replace the use of methods with higher risk of injury (water guns or even use of weapons) on the other hand.

Embodiments of the present invention also concern a membrane for a device for impulse ejection of medium, especially for a device according to an embodiment of the invention in which the membrane during ejection of medium can be deformed elastically to form a passage opening for the medium and in which the membrane has a number of curved slits which extend in one plane perpendicular to the ejection device from the center of the membrane outward.

It was found that with provision of such a membrane, an additional increase in range can surprisingly be achieved. It is assumed that a twist is formed in the jet of ejected medium as a result of curvature of the slits and the related special formation of the passage opening through the membrane. The twist helps stabilize the jet against premature winding and dispersal or atomization.

Embodiments of the present invention also concern a method for increasing the range of impulse ejection of medium with the steps of a first and second impulse ejection of medium, the second impulse ejection being coordinated in time and space with the first impulse ejection so that the second impulse ejection is essentially connected to the first impulse ejection to increase its range.

With appropriate adjustment of the second impulse ejections, which can also be referred to as shots, a situation can be achieved in which the second shot effectively follows in the "wind shadow" of the first shot, in which case an increased range can be attained for the second shot through the "wind shadow" effect.

The nozzle element in an advantageous variant of the present invention during ejection of medium can be brought by the medium from the rest position to the ejection position. Movement of the nozzle element can therefore already be achieved by the ejecting medium, so that a separate control, be it mechanical or otherwise, can be dispensed to move the nozzle element from the rest position to the ejection position. This permits a particularly simple and robust design.

In another advantageous variant of the present invention, the nozzle element defines a nozzle internal space through which the medium can pass during ejection, the nozzle's internal space widening in a direction opposite the ejection direction. Widening gives the medium a simple opportunity to produce movement of the nozzle element without causing any interfering eddies or other irregularities in the flow path of the ejected medium.

In another advantageous variant of the present invention, the nozzle element can be brought from an ejection position to a rest position by means of a restoring force, the restoring force being obtained from deformation of the membrane. The membrane is elastic and the restoring force of the membrane that occurs during deformation is utilized for this purpose or at least contributes to bringing the nozzle element back to the rest position. The ejection position and the rest position are preferably chosen so that the restoring force alone of the membrane can cause the return movement of the nozzle element. In particular, the nozzle element should be prevented from deforming the membrane in such a way that the restoring force then active no longer has sufficient force along the ejection direction. During ejection, the nozzle element is held in the ejection position against the restoring force of the membrane by the continuous effect of the ejected medium.

As an alternative or in addition, a separate spring element or other return device can be provided for the nozzle element, with which it is returned to the rest position after ejection of the medium. It can be designed in particular to selectively do this in the event that "automatic" return through the restoring force of the membrane is not sufficient.

In another advantageous variant of the present invention, the membrane has a number of slits which extend outward in a plane perpendicular to the ejection direction from the center of the membrane. With such a variant, a desired and reproducible outlet opening can be guaranteed with particular simplicity.

In another advantageous variant of the present invention, the slits have a curvature. It was found that an additional improvement in range and jet stability can be achieved with curved slits. It is assumed here that one reason for this improvement might be that the ejected medium jet is provided with a stabilizing twist by the shape of the outlet opening produced with the curved slits.

Another advantageous variant of the present invention has a damping space arranged between the nozzle element and the ejection tube, which is connected, at least when the nozzle element is in the rest position, to the internal space of the ejection tube to receive the medium. During filling of the ejection tube with medium in this variant, the medium also reaches the damping space, from which it is forced out by movement of the nozzle element caused by ejection, for example, through openings provided on an impact surface of the nozzle element. Here the desired damping can be set by the size and number of openings in cooperation with the properties of a medium. With damping and the related avoidance of almost non-braked impact of the nozzle element against the stop provided for it (which defines the ejection position), materials can be spared in operation, thus requiring less maintenance and spare part replacement.

In another advantageous variant of the present invention, the nozzle element has at least one feed opening and/or feed recess through which the nozzle's internal space is connected to the damping space for passage of the medium in the rest position. In this way the damping space can be connected to the internal space in the nozzle element and therefore to the interior of the ejection tube simply and without additional expense.

In another advantageous variant of the present invention, the nozzle element has at least one damping opening through which medium can pass from the damping space during movement of the nozzle element from the rest position to the ejection position. The size and optionally the number of damping openings permits deliberate adjustment of the damping properties in coordination with the material properties of the medium. From another standpoint, the medium is not driven out from the damping space here; instead, part of the nozzle element is moved through the damping space, in which case resistance is offered to this movement to produce damping.

In another advantageous variant of the present invention, the nozzle element has a number of holes arranged in such a way that during ejection of the medium, gas can be entrained from the surroundings through the holes. It was found that entrainment of gas from the surroundings, generally air, also contributes to improved jet stability in the ejected jet.

In a particularly advantageous variant, the holes are identical to the aforementioned feed openings, giving these openings a dual advantageous function.

Another advantageous variant of the present invention includes a guide sleeve, with which the nozzle element and ejection tube are coupled to each other and which is equipped to guide the nozzle element. With the provision of a guide sleeve, which is advantageously formed in two parts to accommodate the nozzle elements, costly adjustment or design of the ejection tube with respect to guiding of the nozzle element can be avoided, the ejection tube needing only to be suitable to accommodate the guide sleeve.

In another variant, the aforementioned widening of the internal space of the nozzle element in a direction opposite the ejection direction is also continued in a widening of the guide sleeve on the other side of the nozzle element.

In an advantageous variant of the present invention, the device is equipped to build up a variable pressure of a propellant for impulse-like driving out of the medium. It was found that with different propellant pressures, an effect can be exerted on the range of ejection of the medium.

In an advantageous variant of the present invention, the device is equipped with at least two adjacent ejection tubes for at least coordinated impulse-like driving out of the medium at least twice. Here the second impulse ejection is essentially connected to the first impulse ejection. In the corresponding coordination between two ejections of medium, it was found that an improved range can be achieved from both ejections. A reason for the improvement might be that one of the impulse ejections to a certain extent follows in the wind shadow of the other one.

In an advantageous variant of the present invention, the device is equipped to alternately release the nozzle element for movability or to fix the nozzle element. With alternating fixing or movability of the nozzle element, two different modes of impulse ejection can be chosen. With a fixed nozzle element, ejection essentially occurs according to the usual ejections, whereas with a moving nozzle element the method according to embodiments of the invention is used.

The medium is preferably a liquid, especially because of simpler handling, in which water is particularly suited in many cases as a medium or as a main component (carrier) of the medium. Other liquids or liquid mixtures, however, can also be provided according to the invention. In addition to a liquid medium, however, a solid medium can also be used according to the prior art mentioned in the introduction, for example, in the form of sufficiently fine powder.

The propellant is advantageously gaseous, in which case air is especially suited as propellant given its easy availability. However, other gases or gas mixtures can also be used.

Depending on the dimensioning of the device, the invention can be implemented either in a portable version for a person, in a mobile version mounted on a vehicle or in a structure installed on the ground or on a building, the actual invention being independent of the size layout.

BRIEF DESCRIPTION OF THE SEVERAL VIEWS OF THE DRAWINGS

Embodiments of the present invention are further explained below using advantageous practical examples with reference to the accompanying figures.

DETAILED DESCRIPTION

Figure 1:
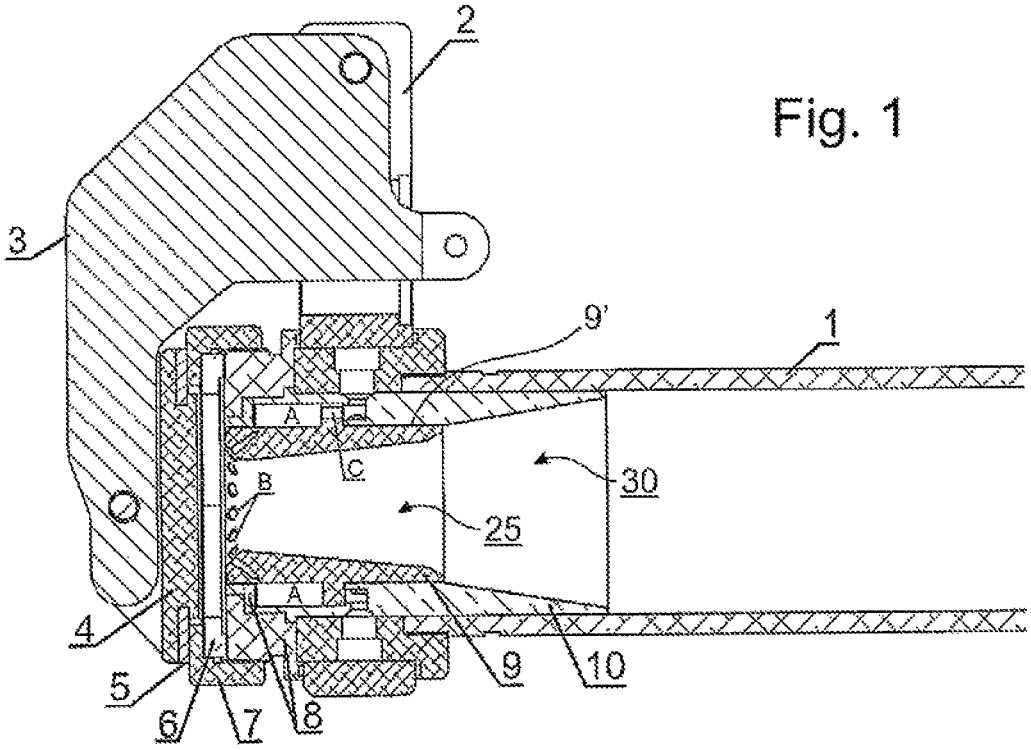
FIG. 1 schematically depicts a sectional view of an ejection end area of one variant of the device according to one embodiment of the invention with the nozzle element in rest position.

FIG. 1 schematically depicts a sectional view of the ejection end area of a variant of the device according to one embodiment of the invention with the nozzle element 9 in rest position 9'. This also represents the rest state of the device.

The device partially depicted in FIG. 1 includes an ejection tube 1 and is equipped with a membrane 6 and a nozzle element 9. The nozzle element 9 is arranged to be movable in a guide sleeve and is guided by this guide sleeve between the rest position 9' and the ejection position 9" (see FIG. 2). The guide sleeve, including a guide bushing 8 and a sliding bushing 10, is introduced to the ejection end area of the ejection tube 1. In addition, the device has an attachment 2 on which a muzzle flap 4 is mounted via a toggle joint 3. This attachment 2 can also serve to connect two ejection tubes 1 arranged adjacent to each other. A slotted membrane (see FIG. 3) is mounted on the outer end (on the left in the depiction in FIG. 1) of guide bushing 8 by means of a swivel nut 7, which essentially seals off the internal space of the ejection tube 1. As a result of this slit, this sealing off is not tight relative to passage of the medium (here water), in which a sealing effect is achieved by seal 5 arranged between the muzzle flap 4 and the swivel nut 7. Seal 5 is mounted in the muzzle flap 4.

In the rest state, the opening of the tube (on the left end in FIG. 1 of the depiction) is closed, the ejection tube 1 initially still not being filled with medium. The nozzle element 9, here also called sliding nozzle body 9, is then situated with the front edge (left) flush behind the rubber membrane 6 in the rear end position (to the right in FIG. 1) so that damping space A is formed between nozzle element 9 and the guide sleeve with guide bushing 8 and sliding bushing 10. The damping space runs in circular fashion around the entire nozzle body 9.

Toward the front, the water chamber (in this example water is used as the medium) is sealed by a rubber seal 5 between the muzzle flap 4 and the swivel nut 7, which holds the rubber membrane 6. The pressure of the muzzle flap necessary for sealing is applied via a toggle joint 3. This is mounted to rotate in the connection plate 2, via a pneumatic cylinder, which pulls the flap 4 in the direction of the tube. The water chamber is filled with water via a pump, in which case the air initially still present in the chamber escapes through a vent via the connection plate 2. The water rises to the sealing surface between the muzzle flap 4 and the swivel nut 7. When the water reaches this site, it continues to flow through nozzle holes B into the damping space A and completely fills it.

Figure 2:
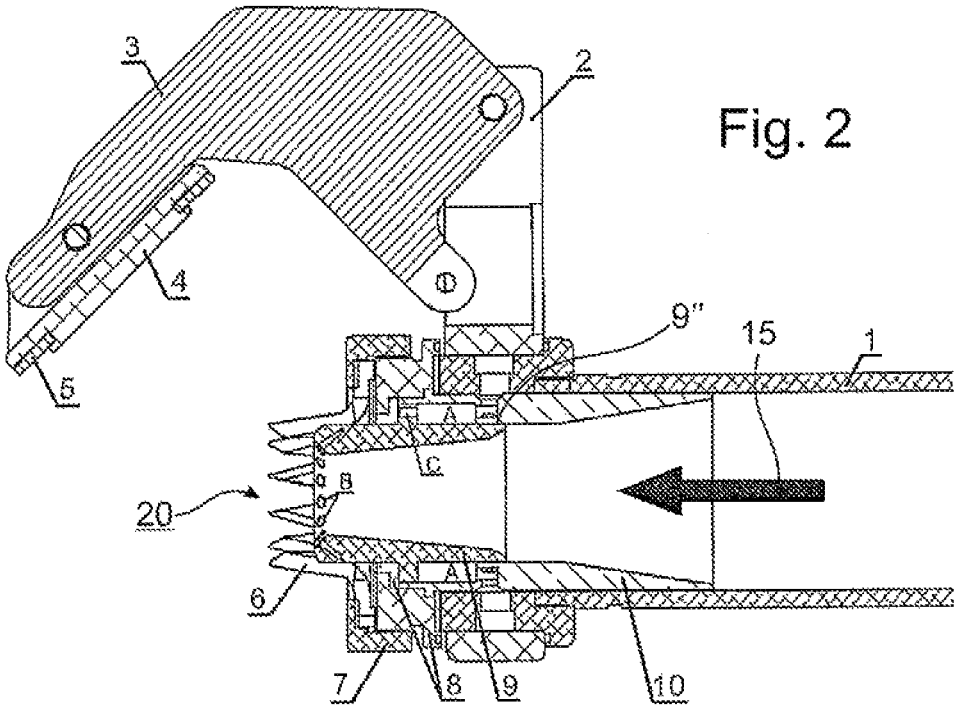
FIG. 2 schematically depicts a sectional view of the ejection end area of the variant with the nozzle element in the ejection position comparable to FIG. 1.

The nozzle element 9 is designed to widen in a direction opposite the ejection direction (see FIG. 2). This widening of the nozzle element 9 continues in sliding bushing 10. A tapering both of the inner area 30 of the sliding bushing and the inner area 25 of the nozzle element is therefore produced in the ejection direction. As a result of this tapering, during passage of medium a force effect is produced on nozzle element 9 during ejection, with which it is moved to the ejection position in the ejection direction in order to open membrane 6.

A widening edge is also provided on the outside (to the left in FIG. 1) on the interior of the nozzle element 9, into which holes B running obliquely to the ejection direction discharge. In the rest position these holes B permit inflow of medium into the damping space A.

FIG. 2 schematically depicts a sectional view comparable to FIG. 1 of the ejection end area of the variant with the nozzle element 9 in the ejection position 9", in which the muzzle flap 4 is opened. The ejection direction 15 is indicated by an arrow in FIG. 2.

The shot is first triggered after opening the muzzle flap 4 using an end switch on the pneumatic cylinder. The water contained in the water chamber is forced forward from the tube 1 with high pressure and corresponding velocity, so that the nozzle element 9 is forced quickly forward and penetrates the rubber membrane 6. During the forward movement of the nozzle element 9, which takes about 0.5 seconds, the water situated in damping space A is forced rearward through the damping holes C so that the nozzle element 9 only stops against the flat surface (to the left of the figure) of the guide bushing 8, producing the ejection position 9" depicted in FIG. 2. The excess water is returned to the water chamber from the damping space A via additional holes that lie on the periphery of sliding bushing 10. After the shot, the nozzle element 9 slides back into its initial position 9' through the spring force of rubber membrane 6 and the muzzle flap 4 is closed again pneumatically.

In the ejection position 9', the openings of holes B opposite the inside of the nozzle element 9 are exposed, making it possible for air from the surroundings to flow through the holes B. The medium passing through the nozzle element 9 during ejection can therefore entrain air from the surroundings through these holes B, additionally stabilizing the ejected jet.

Figure 3:
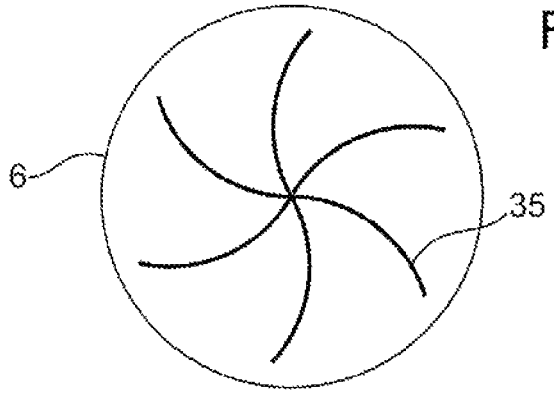
FIG. 3 schematically depicts a view of a variant of a membrane according to an embodiment of the invention with curved slits.

FIG. 3 schematically depicts a top view of a variant of a membrane 6 according to one embodiment of the invention with curved slits 35.

The membrane 6 in the embodiment depicted in FIG. 3 includes a total of six slits, each of which emerge symmetrically from the center of membrane 6 and are curved to the right. As an alternative, the variant from FIG. 3 can also be described with three symmetric slits that run through the membrane 6, meet in the center of membrane 6 and then change their direction of curvature.

In the variant of FIG. 3, the slits each possess continuous curvature that is also the same in comparison with each other, the present invention not being restricted to this. It is also possible to provide a left-running curvature.

Figure 4:
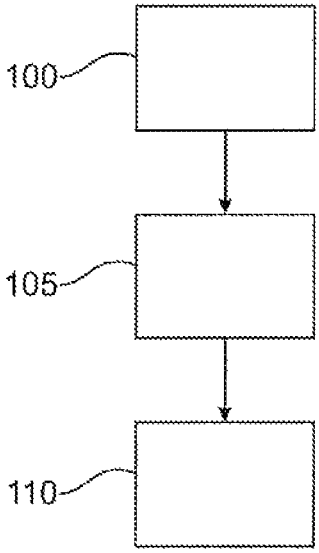
FIG. 4 schematically depicts a process diagram of a variant of a method according to the invention according to a first aspect.

FIG. 4 schematically depicts a process diagram of a variant of the method according to the invention according to a first aspect.

According to the first aspect, ejection of the medium begins in step 100 and leads to movement of a nozzle element in the ejection end area of the ejection tube of a device for impulse ejection of a medium. Movement occurs in step 105 and in turn leads to deformation of the membrane in step 110 to form a passage opening in the membrane. The deformation caused by displacement of the nozzle element is at least superimposed at the beginning of the ejection of the medium with a deformation caused by the ejected medium itself, in which case deformation is essentially caused only by the nozzle element in a preferred variant during the later stage of ejection. This nozzle element in turn is held in the ejection position by the emerging medium against the restoring force of the membrane.

Figure 5:
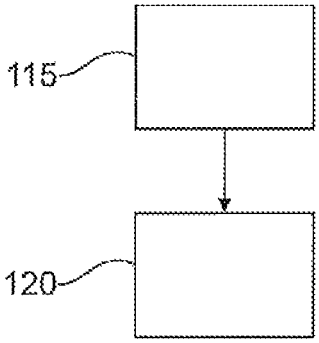
FIG. 5 schematically depicts a process diagram of a variant of a method according to the invention according to a second aspect.

FIG. 5 schematically depicts a process diagram of the variant of the method according to the invention according to a second aspect.

According to this second aspect, two impulse ejections 115 and 120 follow in spatial and temporal coordination with each other, so that medium ejected during one of the impulse ejections to a certain extent follows in the wind shadow of the medium of the other impulse ejection, thus increasing the range. With the technology now available, a sufficient time proximity of two impulse ejections can only be achieved with considerable technical complexity (if at all). However, it was found that with an arrangement of two adjacent and independent ejection tubes, corresponding time coordination is comparatively simple to achieve as long as the distance of the ejection ends across the ejection direction with essentially the same ejection direction is sufficiently small relative to the desired shot range. Good results can be achieved at distances of as little as 0.5 m and less at shot ranges of 30 m and more. The ejection ends do not have to be situated at the same height; for example, one of the ejection tubes can also be offset in the ejection direction relative to the other one, in which case a wind shadow effect can also be achieved during a simultaneous shot of both ejection tubes.

Operation of another advantageous variant (not shown) of the present invention is described below, which corresponds in its dimensioning to the known IFEX Dual Intruder (see above). The device is equipped with a target device for visual alignment of the ejection direction and a laser unit as a means to determine the distance between the ejection tube and the target. A safety is provided, which permits full impact (12 L of water driven out with 36 bar of air pressure corresponding to a force effect of roughly 250 kilo) at a distance of less than 30 meters only after separate release-unlocking A camera that records the target field can be connected here, for example, to a central office via a satellite connection. As an alternative or in addition, the images recorded by the camera can also be stored locally for documentation. The device is provided with a hydraulic control or corresponding motor and includes a power pack (including water pump, hydraulics, compressor in a compact arrangement). Fully automatic proportioning of an additive like CS gas is possible, in which incorrect proportioning is prevented by the dimensioning of the additional device. Conventional, commercially available products are used for the target device, distance determination and camera.

The device is provided with a muzzle flap in addition to the rubber membrane provided in stellate fashion with curved slits (see FIG. 3), which prevent water from emerging as might otherwise occur, especially in a downward sloped ejection tube. The muzzle flap is opened in a time range of a few milliseconds before the shot, ensuring that no shot is triggered if the muzzle flap is not opened.

In the tube end the movable nozzle element is provided, which is moved during a shot in the shooting direction by the water and then opens the membrane notched in stellate fashion. Because of the elasticity of the membrane, the nozzle element is pushed back into the tube to its rest position after the shot. The main jet with this arrangement is maintained for about 20 meters, a distance at which the jet has already widened to 4.5 m in the ordinary IFEX Dual Intruder. Finally, however, the jet widens to an atomized cloud, in which the added CS gas is also dispersed. The forming CS gas cloud is larger than the water cloud during extinguishing use and also remains in the air longer before eventual precipitation.

In the tube area, which essentially coincides with the schematic depictions in FIGS. 1 and 2, additional holes are provided through which the liquid used for the shot can reach in front of an extension of the movable nozzle element (space A in FIG. 1). This permits damping during the shot, so that the nozzle element during the shot does not strike its guide in the guide sleeve in a non-braked manner.

The distance at which the main cloud occurs can be adjusted, for example, via the ejection pressure, which can be increased from the 25 bar previously used to 35 bar. It was found that controlled shot ranges of up to 60 m can be achieved with the variants presented above.

The possible use of embodiments of the present invention in the area of riot control has already been discussed. The device and method according to embodiments of the invention, however, can also be used in the area of firefighting, like the known devices. Additional possibilities lie in the neutralization/detoxification of a contaminated area (where for example, instead of adding an irritant gas, an appropriate neutralizing agent or antidote can be used alone or with water or another carrier as medium) or in targeted delivery of a treatment agent or fertilizer in the field of agriculture (for example in the form of a fungicide in viticulture).

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device for impulse ejection of a medium, the device comprising:

an ejection tube for the medium from which the medium can be driven out by a propellant impulse-like in an ejection direction through an ejection end of the ejection tube;

a membrane provided in an area of the ejection end of the ejection tube, the membrane having a plurality of curved slits in an un-deformed configuration which extend radially outward from a center of the membrane, and the membrane being elastically deformable to form a passage opening for the medium during ejection of the medium; and a nozzle element operatively coupled to the ejection tube to move along the ejection direction between a rest position and an ejection position and to enable the medium to interact with the membrane during ejection to improve range and stability of the ejected medium, wherein the nozzle element in moving to the ejection position causes deformation of the membrane to form the passage opening and in the rest position produces smaller or no deformation of the membrane, and wherein the nozzle element during ejection of the medium can be brought from the rest position to the ejection position.

2. The device of claim 1, in which the nozzle element during ejection of the medium can be brought from the rest position to the ejection position by the medium.

3. The device of claim 1, in which the nozzle element defines a nozzle internal space, through which the medium can pass during ejection, the nozzle internal space widening in a direction opposite the ejection direction.

4. The device of claim 1, in which the nozzle element can be brought by a restoring force from the ejection position to the rest position, the restoring force being obtained from deformation of the membrane.

5. The device of claim 1 wherein a damping space is arranged between the nozzle element and the ejection tube, the damping space connected to the internal space of the ejection tube to receive the medium at least when the nozzle element is situated in the rest position.

6. The device of claim 5, in which the nozzle element has at least one opening through which the nozzle internal space is connected to the damping space for passage of the medium in the rest position.

7. The device of claim 5, in which the nozzle element has at least one damping opening, through which medium can pass from the damping space during movement of the nozzle element from the rest position to the ejection position.

8. The device of claim 1, in which the nozzle element has a number of holes, arranged in such a way that during ejection of the medium, gas can be entrained from the surroundings through the holes.

9. The device of claim 1, further comprising:

a guide sleeve coupled to the ejection tube which is equipped for guiding the nozzle element.

10. The device of claim 1, in which the device is equipped to build up a variable pressure of the propellant for impulse-like ejection of the medium.

11. The device of claim 1, further comprising:

a supplemental ejection tube adjacent the ejection tube for at least time-coordinated impulse-like ejection of the medium at least twice, and wherein the second impulse ejection essentially follows the first impulse ejection.

12. The device of claim 1, in which the device is equipped to alternately release the nozzle element for movability or impede movement of the nozzle element.

13. A method for impulse ejection of a medium from an ejection tube of a device for impulse ejection of the medium, in which the device has a membrane in an area of an ejection end of the ejection tube and a nozzle element in the ejection tube, the method comprising:

moving the nozzle element from a rest position to an ejection position during ejection of the medium;

elastically deforming a plurality of distinct portions of the membrane defined by a number of curved slits that extend radially outward from a center of the membrane to form a passage opening for the medium; and causing the medium to interact with the membrane to improve range and stability of the ejected medium as the medium passes through the passage opening defined by the membrane during ejection of the medium.

14. The method of claim 13, further comprising:

initiating a first impulse ejection of the medium; and initiating a second impulse ejection of the medium, in which the second impulse ejection is coordinated in time and space with the first impulse ejection so that the second impulse ejection is connected essentially to the first impulse ejection in order to increase its range.

15. A device for impulse ejection of a medium, the device comprising:

an ejection tube having an ejection end;

a membrane coupled to the ejection end of the ejection tube, the membrane having a plurality of curved slits in an un-deformed configuration that extend radially outward from a center of the membrane, and the membrane being configured to elastically deform to form a passage opening for the medium during ejection of the medium; and a nozzle element operatively coupled to the ejection tube to move along an ejection direction between a rest position and an ejection position and to enable the medium to interact with the membrane during ejection to improve range and stability of the ejected medium, wherein the nozzle element in moving to the ejection position causes deformation of the membrane to form the passage opening, and wherein the nozzle element is configured such that a damping space is arranged between the nozzle element and the ejection tube.

16. The device of claim 15 wherein the nozzle element has at least one opening through which an internal space of the nozzle element is connected to the damping space.

17. The device of claim 15 wherein the nozzle element has at least one damping opening through which the medium can pass from the damping space during movement of the nozzle element from the rest position to the ejection position.

18. A device for impulse ejection of a medium, the device comprising:

an ejection tube having an ejection end;

a membrane coupled to the ejection end of the ejection tube, the membrane having a plurality of curved slits in an un-deformed configuration that extend radially outward from a center of the membrane, and the membrane being configured to elastically deform to form a passage opening for the medium during ejection of the medium; and a nozzle element operatively coupled to the ejection tube to move along an ejection direction between a rest position and an ejection position and to enable the medium to interact with the membrane during ejection to improve range and stability of the ejected medium, wherein the nozzle element in moving to the ejection position causes deformation of the membrane to form the passage opening, and wherein the nozzle element includes a plurality of holes positioned such that, during ejection of the medium, gas is entrained from a surrounding environment through the holes.

* * * * *